US006704989B1

(12) United States Patent
Lutz et al.

(10) Patent No.: US 6,704,989 B1
(45) Date of Patent: Mar. 16, 2004

(54) PROCESS FOR ASSEMBLING AND TRANSPORTING AN ELECTRONIC SIGN DISPLAY SYSTEM

(75) Inventors: Robert James Lutz, Bruce, SD (US); Bradley Jon VanderTuin, Brookings, SD (US); Mark Daniel Dennis, Dell Rapids, SD (US)

(73) Assignee: Daktronics, Inc., Brookings, SD (US)

( * ) Notice: Subject to any disclaimer, the term of this patent is extended or adjusted under 35 U.S.C. 154(b) by 26 days.

(21) Appl. No.: 10/027,328

(22) Filed: Dec. 19, 2001

(51) Int. Cl.[7] ..... G09F 13/00

(52) U.S. Cl. ..... 29/428; 29/426.1; 29/426.3; 40/605; 345/903

(58) Field of Search ..... 40/584–624, 452, 40/453, 448; 206/701–728; 340/815.4–815.92; 345/1.1, 1.3, 903; 29/407.09, 407.1, 426.1, 426.3, 428, 469; 294/81.1, 81.2

(56) References Cited

U.S. PATENT DOCUMENTS 4,546,891 A * 10/1985 Lanigan et al. ..... 212/327
4,823,952 A * 4/1989 Fletcher et al. ..... 206/328
4,951,176 A * 8/1990 Bergfried et al.
5,758,442 A * 6/1998 Flanigan ..... 40/624
5,796,376 A * 8/1998 Banks
5,900,850 A * 5/1999 Bailey et al. ..... 345/55
6,079,564 A * 6/2000 DeNola ..... 206/723
6,147,623 A * 11/2000 Rippen
6,175,342 B1 * 1/2001 Nicholson et al. ..... 345/1.1
6,343,006 B1 * 1/2002 Moscovitch et al.
6,504,487 B1 * 1/2003 Pederson ..... 340/815.45

* cited by examiner

*Primary Examiner*—Gregory Vidovich
*Assistant Examiner*—Jermie E. Cozart
(74) *Attorney, Agent, or Firm*—Hugh D. Jaeger

(57) ABSTRACT

A transportable electronic sign display system and process where electronic display modules are encased in castered protective cases which are broken down on site and assembled in rows of desired length and stackably elevated and maneuvered by a lifting truss. Electronic display modules are lifted from protective case bases with minimal effort or labor. Various numbers of rows of desired length of electronic display modules can be stacked to form a desired display size.

37 Claims, 8 Drawing Sheets

PROCESS FOR ASSEMBLING AND TRANSPORTING AN ELECTRONIC SIGN DISPLAY SYSTEM

CROSS REFERENCES TO RELATED APPLICATIONS

None.

BACKGROUND OF THE INVENTION

1. Field of the Invention

The present invention is directed to an electronic display, and more particularly to a transportable electronic sign display system and process.

2. Description of the Prior Art

Electronic sign displays often are incorporated at venues where components of an electronic sign display are moved temporarily to the site and assembled by personnel to display electronically generated alphanumeric information, graphic information, or video information, and then disassembled and removed after use. Such electronic sign displays have included, but have not been limited to, arrays of video monitors or LED displays or the like which were stacked to achieve a desired size. The arrays often include a number of side-by-side connected electronic display modules depending on the length of the array required. The arrays, especially those containing a larger number of electronic display modules, are of a weight and dimension that requires a larger number of personnel than is sometimes readily available to handle and position the array. Such electronic sign displays include graphic displays of a delicate nature and are thus transported in a variety of protective containers and the like. Personnel must then manually lift the weighty and often unwieldy electronic display modules from the protective containers and physically position the electronic display modules for erection at a position which is usually elevated. Clearly what is needed is a method of protection and an efficient shipping and handling process, which includes assembly and disassembly, for an electronic sign display where a minimum of personnel and minimum labor is required. Such is provided by a transportable electronic sign display system and process, the present invention.

SUMMARY OF THE INVENTION

The general purpose of the present invention is to provide a transportable electronic sign display system and process. The transportable electronic sign display system includes stackable electronic display modules which are contained in easily transportable castered cases and a lifting truss which supports arrays of electronic display modules. Electronic display modules are lifted directly from case halves with a minimum of effort and labor.

According to one or more embodiments of the present invention, there is provided a transportable electronic sign display system, including electronic display modules aligned to a protective case base, removable case halves secured to the protective case base encompassing and protecting the electronic display modules, and a lifting truss to which a plurality of electronic display modules in rows or in an array attach and secure.

One significant aspect and feature of the present invention is an electronic sign display system which is transportable and which can be handled by a process whereby arrays of electronic display modules in various sizes can be easily and readily assembled and erected using a minimal assembly crew and minimal effort.

Another significant aspect and feature of the present invention is a transportable electronic sign display system including electronic display modules transported in and protectively contained in protective cases.

Still another significant aspect and feature of the present invention is a transportable electronic sign display system in which electronic display modules are aligningly juxtaposed to form rows and arrays of electronic display modules.

Yet another significant aspect and feature of the present invention is a transportable electronic sign display system having protective cases each of which includes case halves latchingly secured together and to a protective case base which is castered.

A further significant aspect and feature of the present invention is a transportable electronic sign display system having a protective case including a case base which is castered to provide for alignment and realignment with an overhead lifting truss.

Having thus set forth significant aspects and features of the present invention, it is the principal object of the present invention to provide a transportable electronic sign display system and process.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENT

Figure 1:
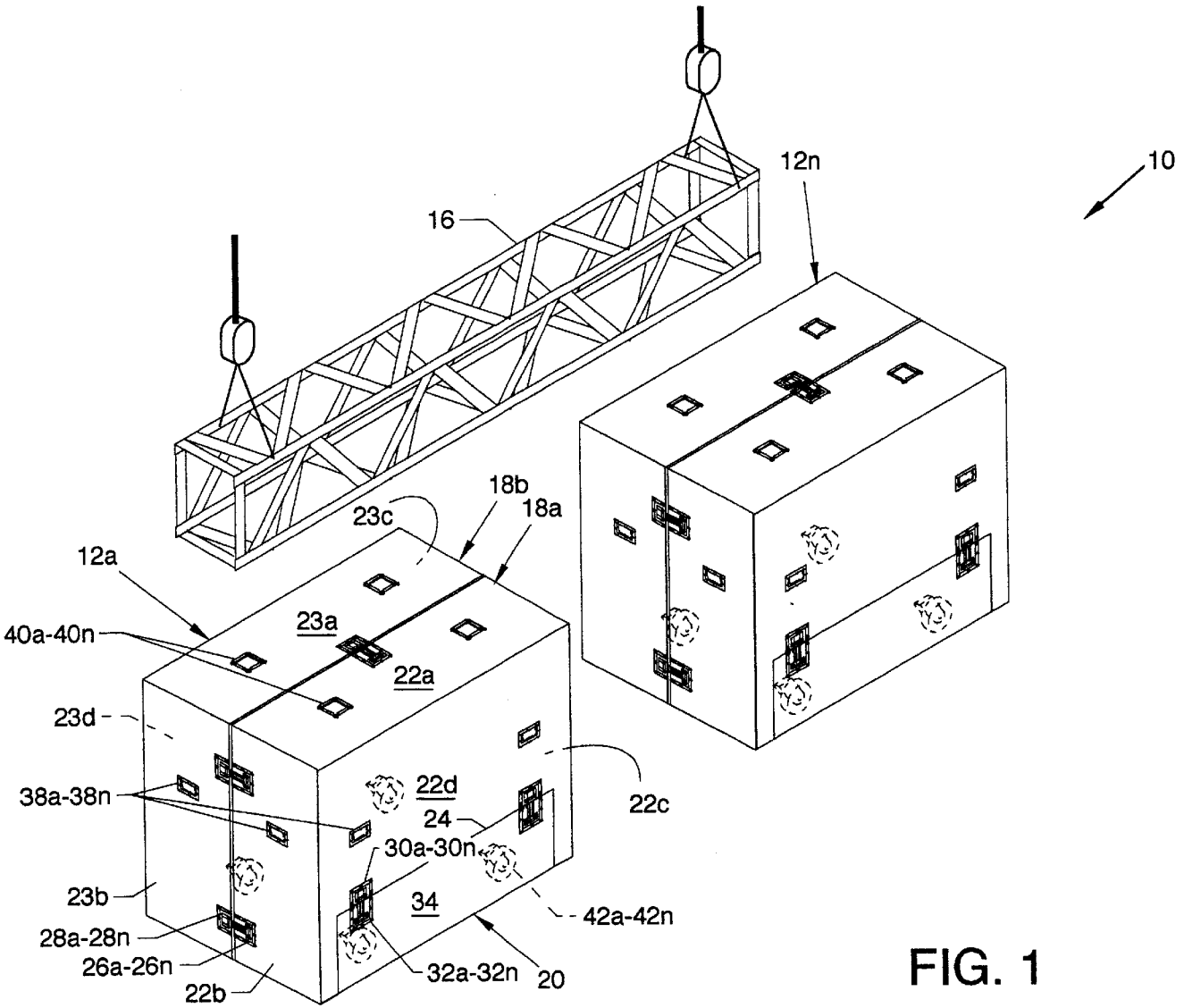
FIG. 1 is an isometric view of the transportable electronic sign display system of the present invention.

FIG. 1 is an isometric view of the transportable electronic sign display system 10 of the present invention. The view illustrates a plurality of identically constructed protective cases 12*a*–12*n,* each of which protectively encompasses and surrounds two of a plurality of electronic display modules 14*a*–14*n,* such as the two electronic display modules 14*a* and 14*b* illustrated in FIG. 2, and a lifting truss 16.

Figure 2:
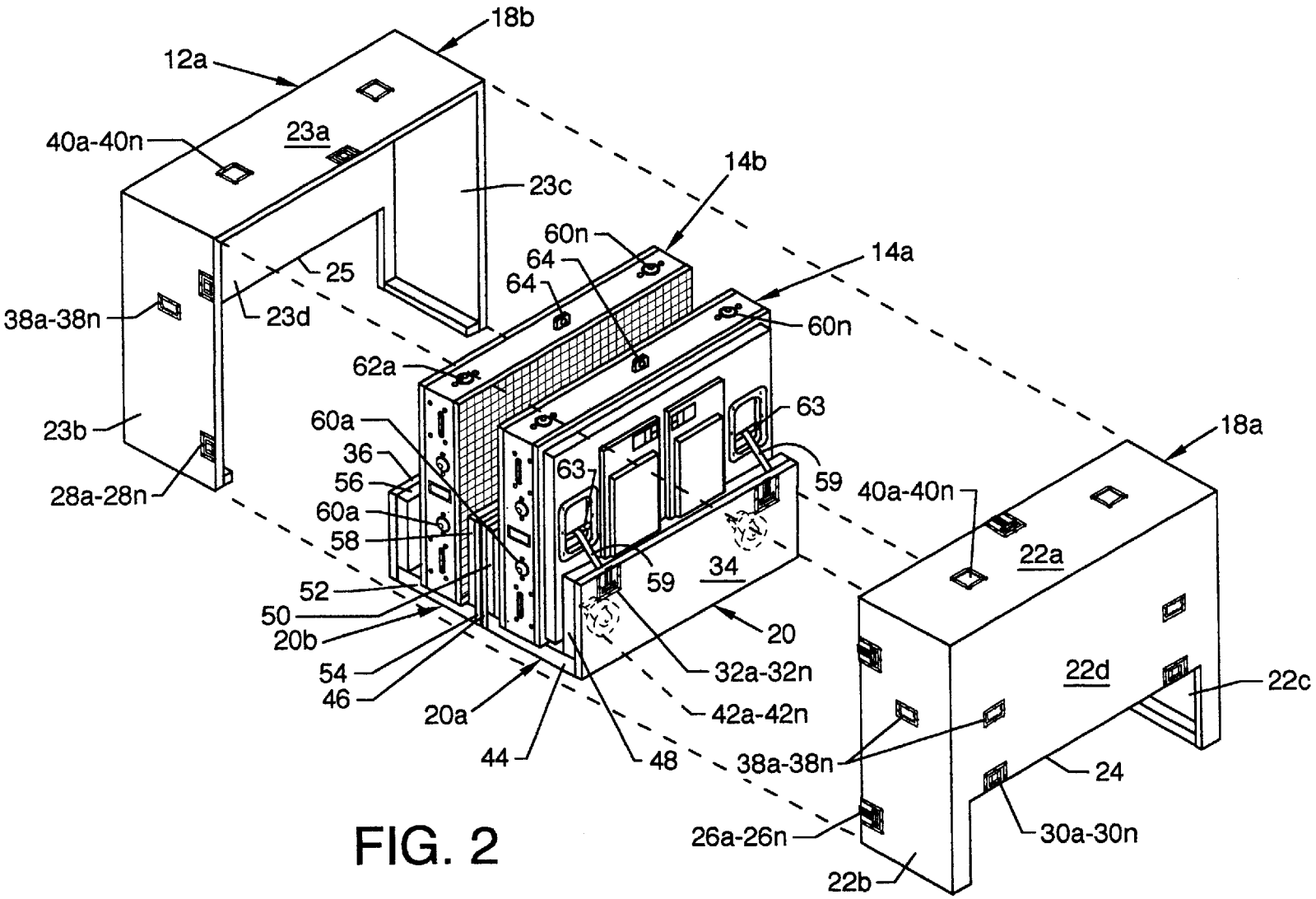
FIG. 2 is an exploded isometric view of the case halves being removed from a case base upon which electronic display modules are supported.

Protective case 12*a* includes separable case halves 18*a* and 18*b* mutually secured to each other and to a case base 20. Case halves 18*a* and 18*b* are substantially similar in construction and each differs from the other only by the latch orientation. Case half 18*a* includes a top 22*a,* opposing sides 22*b* and 22*c,* and a front 22*d* having a cutout 24. Case half 18*b* includes a top 23*a,* opposing sides 23*b* and 23*c,* and a front 23*d* having a cutout 25 (FIG. 2). A plurality of latch actuators 26*a*–26*n* are distributed along and about the inner edges of the top 22*a* and sides 22*b*–22*c* of the case half 18*a*. A plurality of latch receivers 28*a*–28*n* are distributed along and about the inner edges of the top 23*a* and sides 23*b*–23*c* of the case half 18*b*. Corresponding latch actuators 26*a*–26*n* and latch receivers 28*a*–28*n* secure the aligned case halves 18*a* and 18*b* to one another. Another plurality of latch receivers 30*a*–30*n* align along and about the cutout 24 of the front 22*d* of case half 18*a* to mate with latch actuators 32*a*–32*n* located at the edge of a panel 34, such panel 34 being part of the case base 20. Another panel 36 (FIG. 2), being part of the case base 20 and opposing panel 34, includes a similar latch arrangement for fastening of the panel 36 to the front 23*d* of the case half 18*b* at the cutout 25, but is not shown for purposes of brevity. A plurality of handhold fixtures 38*a*–38*n* are distributed along each of the case halves 18*a* and 18*b*. A plurality of stacking dishes 40*a*–40*n* are distributed along the tops 22*a* and 23*a* of the case halves 18*a* and 18*b*. A plurality of casters 42*a*–42*n* secure to the bottom of the case base 20. As stated previously, all of the protective cases 12*a*–12*n* are identical. Therefore, the foregoing description of protective case 12*a* applies to all of the other protective cases as well.

Figure 4:
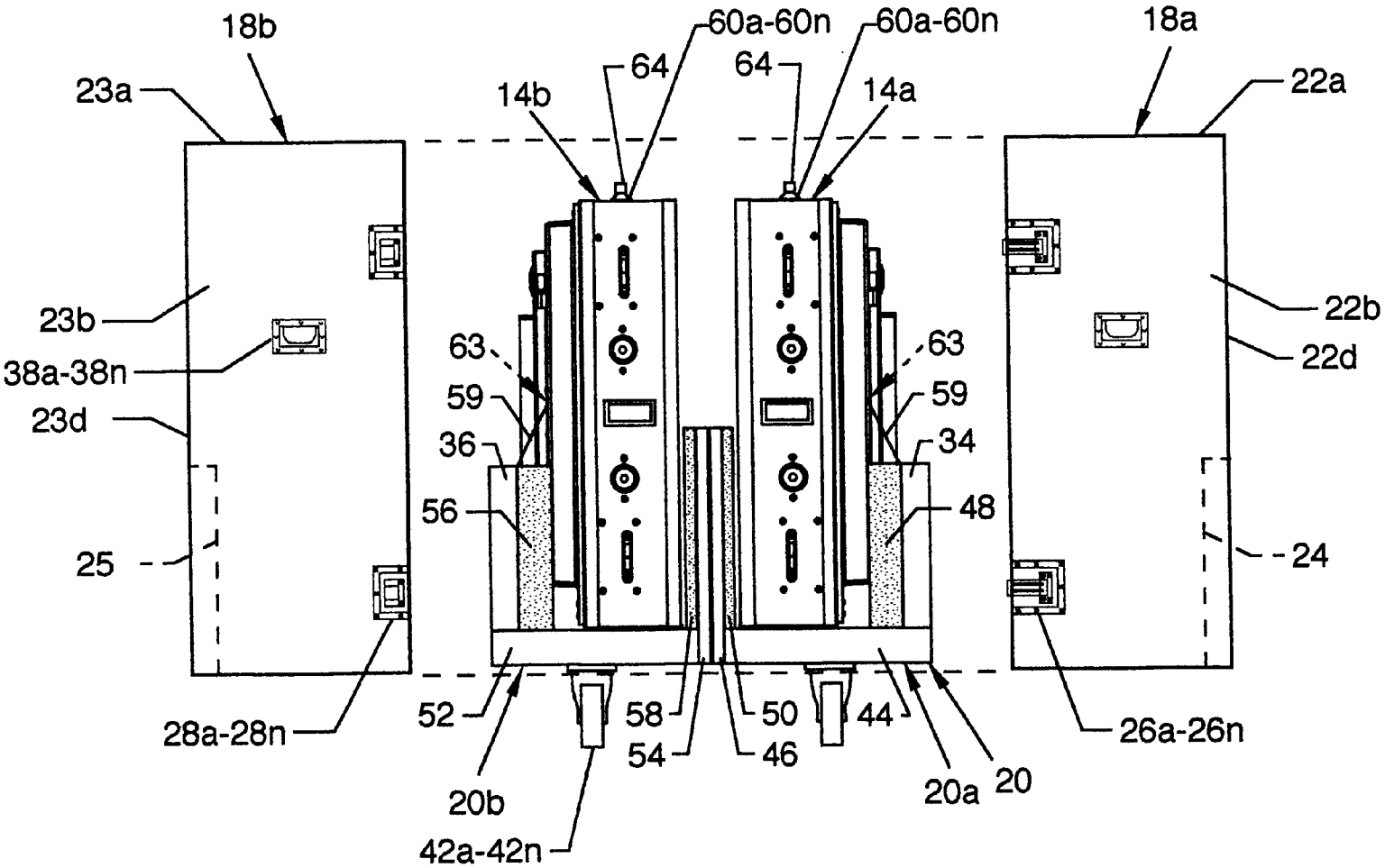
FIG. 4 is an end view of case halves removed from a case base to reveal electronic display modules supported on the case base.

FIG. 2 is an exploded isometric view of the case halves 18*a* and 18*b* being removed from the case base 20. Shown in particular are electronic display modules 14*a* and 14*b* which align to and are supported on the case base 20. The electronic display modules 14*a* and 14*b* can incorporate, for example, delicate light sources such as, but not limited to, light emitting diodes, liquid crystal displays, incandescent lights, and the like. The case base 20 is composed of case base halves 20*a* and 20*b* permanently secured to one another, each half 20*a* and 20*b* having a substantially U-shaped profile into which the electronic display modules 14*a* and 14*b* align. Half 20*a* includes a horizontally aligned bottom 44, a vertically aligned outwardly located panel 34, and an opposing vertically aligned inwardly located panel 46. Protective sculptured shock absorbent and anti-static foam panel 48 secures to the inwardly facing surface of the panel 34 to offer protection for the outwardly facing portion of the electronic display module 14*a,* and another shock absorbent and anti-static foam panel 50 aligns to the outwardly facing portion of the panel 46 to offer protection for the inwardly facing portion of the electronic display module 14*a* having delicate light sources. Half 20*b* is fashioned in the same manner as half 20*a* including a horizontally aligned bottom 52, a vertically aligned outwardly located panel 36, and an opposing vertically aligned inwardly located panel 54. Protective sculptured shock absorbent and anti-static foam panel 56 secures to the inwardly facing surface of the panel 36 to offer protection for the outwardly facing portion of the electronic display module 14*b,* and another shock absorbent and anti-static foam panel 58 aligns to the outwardly facing portion of the panel 54 to offer protection for the inwardly facing portion of the electronic display module 14*b* having delicate light sources. Shock absorbent and anti-static foam panels 50 and 58 normally do not contact the inwardly facing portions of the electronic display modules 14*a* and 14*b*. The shock absorbent and anti-static foam panels 50 and 58 offer protection against inadvertent positioning during removal of or placement of the electronic display modules 14*a* and 14*b* from and into the case base halves 20*a* and 20*b*. For transport, the electronic display modules 14*a* and 14*b* are secured to the case base halves 20*a* and 20*b,* respectively, by a plurality of like securing straps 59 which are permanently fastened at one end to the upper region of each of panel 34 and panel 36 (FIG. 4). The other end of each of the securing straps 59 secures to like handle fixtures 63 located on the outwardly facing portions of the electronic display modules 14*a* and 14*b*. Straps 59 are disengaged from the handle fixtures 63 during the assembly process. Electronic display modules 14*a*–14*n* include male or female alignment fixtures 60*a*–60*n* appropriately gendered and located along and about the periphery of each electronic display module to provide for mated alignment of electronic display modules 14*a*–14*n* along vertical and horizontal axes to form arrays of electronic display modules 14*a*–14*n,* as shown later in detail. Electronic display modules 14*a*–14*n* include lifting lugs 64.

Figure 3:
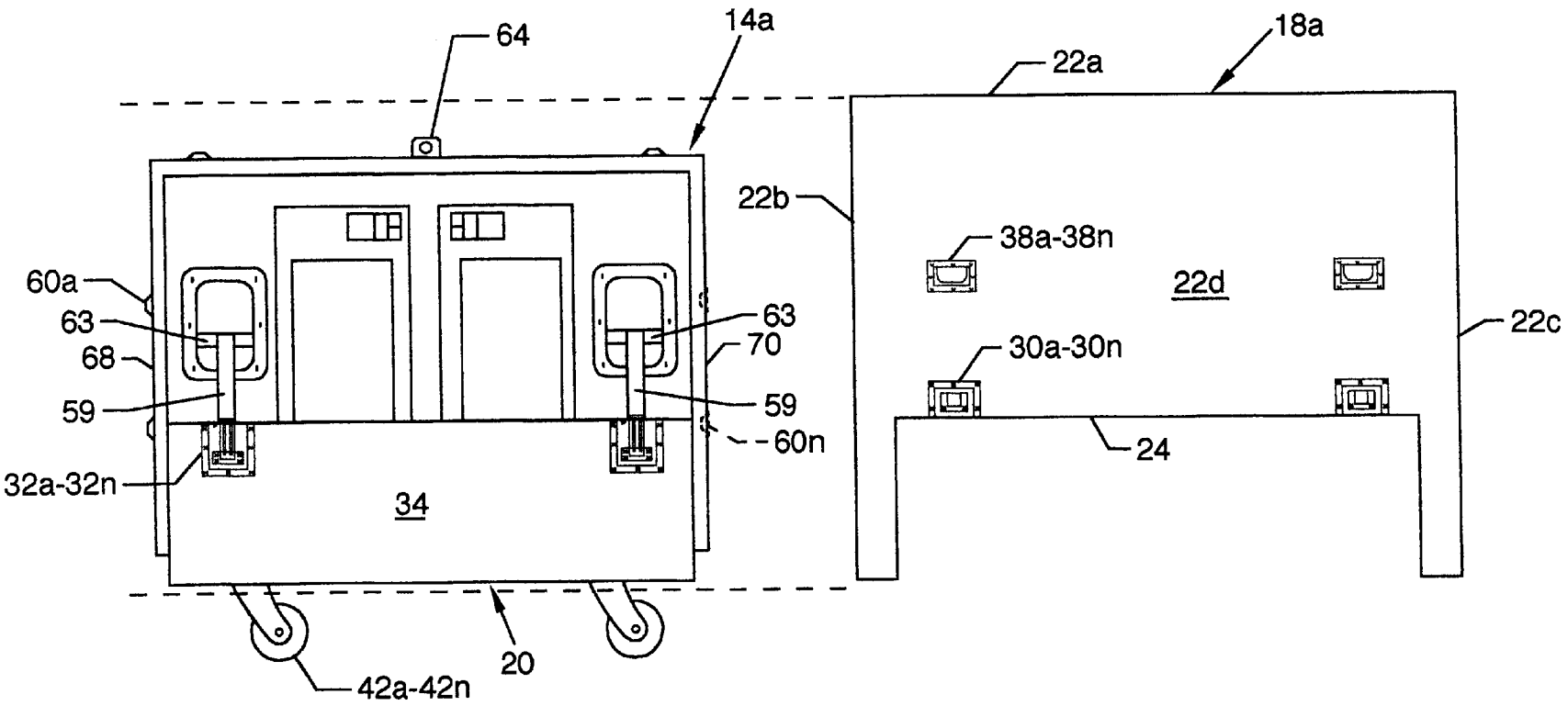
FIG. 3 is a side view of an electronic display module supported on a case base, and also one of the case halves which has been removed from the case base.
Figure 5:
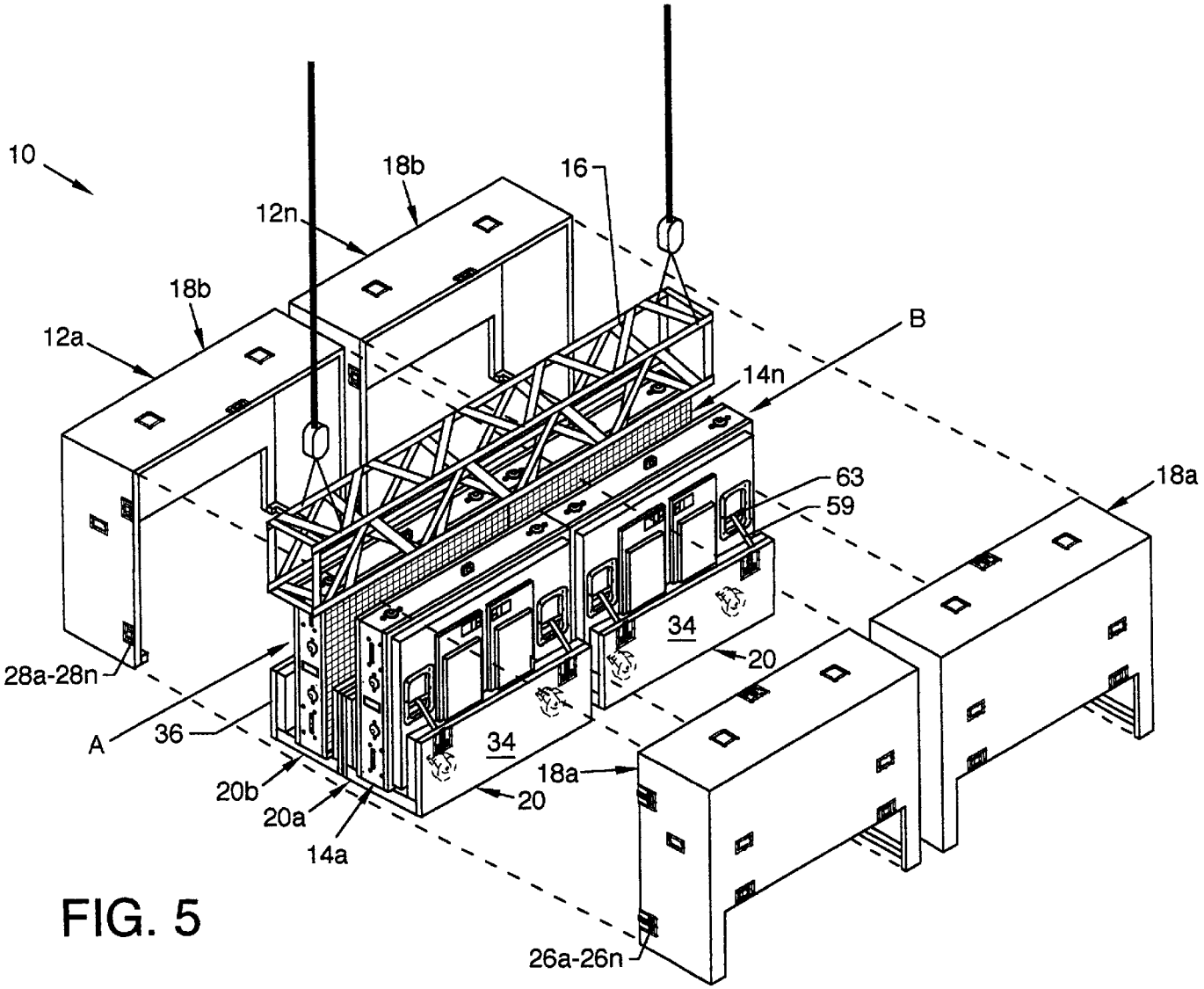
FIG. 5 illustrates the first steps of the process of the invention.

FIG. 3 is a side view of the electronic display module 14*a* supported on the case base 20, and also the case half 18*a* which has been removed from the case base 20. Shown in particular is the relationship of the length of the electronic display module 14*a* to the length of the case base 20. The length of each of the electronic display modules 14*a*–14*n* exceeds that of an associated case base 20 such that the ends 68 and 70 of the electronic display modules 14*a*–14*n* extend over the edges of the associated case base 20 slightly, thereby allowing unobstructed close alignment and coupling of adjacently aligned electronic display modules 14*a*–14*n,* such as indicated in FIG. 5.

FIG. 4 is an end view of case halves 18*a* and 18*b* removed from the case base 20 to reveal the electronic display modules 14*a* and 14*b* residing in the case base halves 20*a* and 20*b,* respectively. Shown especially are the foam panels 48 and 50 in the case base half 20*a* and the foam panels 56 and 58 in the case base half 20*b* protectively juxtaposing electronic display modules 14*a* and 14*b,* respectively.

Mode of Operation

FIGS. 5, 6, 7 and 8 illustrate the mode of operation of the transportable electronic sign display system 10 including the process of protectively encasing electronic display modules in protective cases, removing case halves of the protective cases, aligning and mating electronic display modules from a rear position of adjacently positioned case bases in end-to-end relationship to form a first row of electronic display modules while on adjacently positioned maneuverable case bases, lowering a lifting truss to meet and attach to the aligned and mated electronic display modules in the first row, raising the lifting truss to remove the first row of aligned and mated electronic display modules from the case bases to a position above the adjacently positioned case bases, maneuveringly rotating the case bases 180 degrees to place remaining electronic display modules into a second row of electronic display modules beneath and in alignment with the suspended first row of electronic display modules, lowering the lifting truss and attached first row of electronic display modules to meet and attach to the second row of electronic display modules in adjacent case bases, thus forming an array of electronic display modules, and, again raising the lifting truss to remove the second row of electronic display modules from adjacent case bases and to elevate such array to a viewable elevated position. In such a process, minimal handling of the electronic display modules is required. The electronic display modules remain in the case bases and are mechanically lifted directly therefrom without a laborious first manual unloading of the electronic display modules from the case bases. Manual unloading of the often heavy and cumbersome electronic display modules is not required.

FIG. 5 illustrates the first steps of the process of the invention. The case halves 18*a* and 18*b* of the protective cases 12*a* and 12*n*, each encasing and surrounding two electronic display module, are separated and removed after disengagement of latch actuators 26*a*–26*n* from latch receivers 28*a*–28*n* and disengagement of latch actuators 32*a*–32*n* from latch receivers 30*a*–30*n*. The castered case bases 20 of each of the protective cases 12*a* and 12*n* are easily maneuvered to adjacent positions to closely align and juxtapose the rearwardly located electronic display modules in the case bases 20 to form a first row A of aligned and mated electronic display modules that includes electronic display module 14*n* and to closely align and juxtapose the forwardly located electronic display modules in the case bases 20 to form a second row B of aligned and mated electronic display modules that includes electronic display module 14*a*. The lifting truss 16 is then lowered to meet and attach by suitable means to the lifting lugs 64 extending from the upper regions of the aligned and mated electronic display modules in the first row A.

Figure 6:
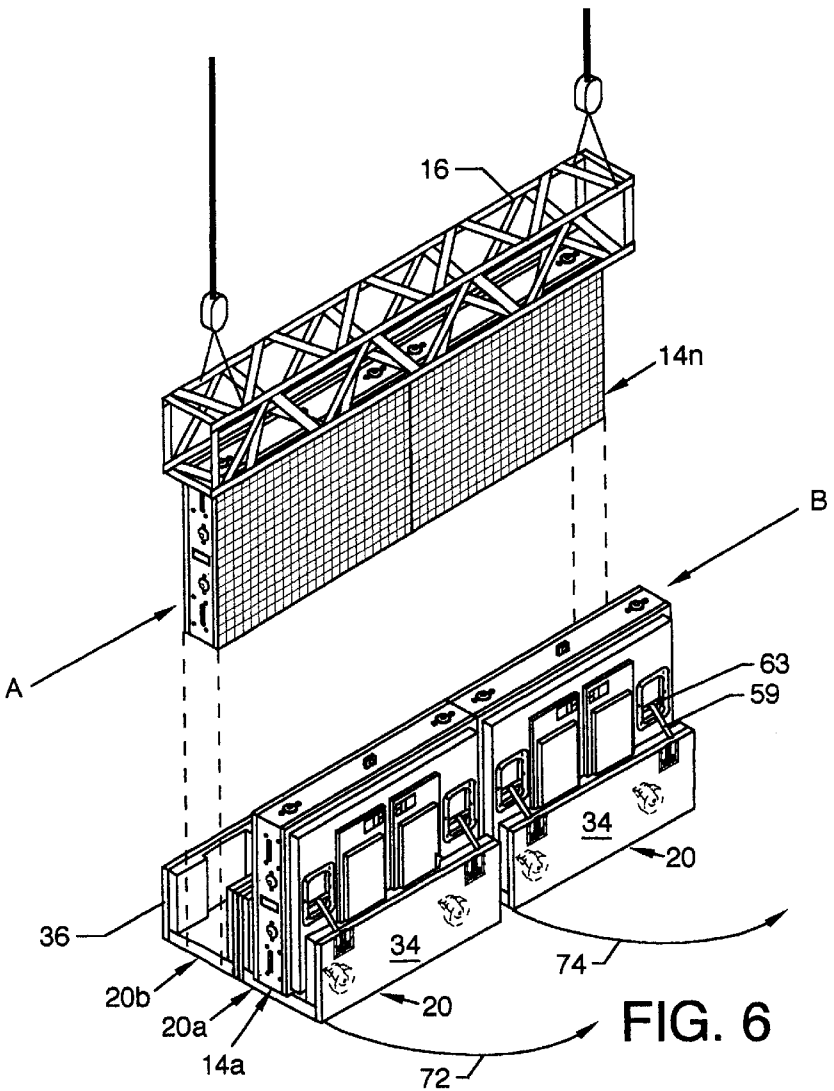
FIG. 6 illustrates the lifting of a first row of aligned and mated electronic display modules from case bases to a position above adjacently positioned aligned and mated electronic display modules supported on the case bases.

FIG. 6 illustrates the lifting of the first row A of aligned and mated electronic display modules from the case bases 20 to a position above the second row B of adjacently positioned aligned and mated electronic display modules supported on the case bases 20. Subsequent to such lifting of the first row A of aligned and mated electronic display modules, the case bases 20 are rotated 180 degrees, as shown by arrows 72 and 74, to a position as shown in FIG. 7, whereby the aligned and mated electronic display modules of the second row B, which are still resting in the case bases 20, become aligned and mated to the electronic display modules of the first row A.

Figure 7:
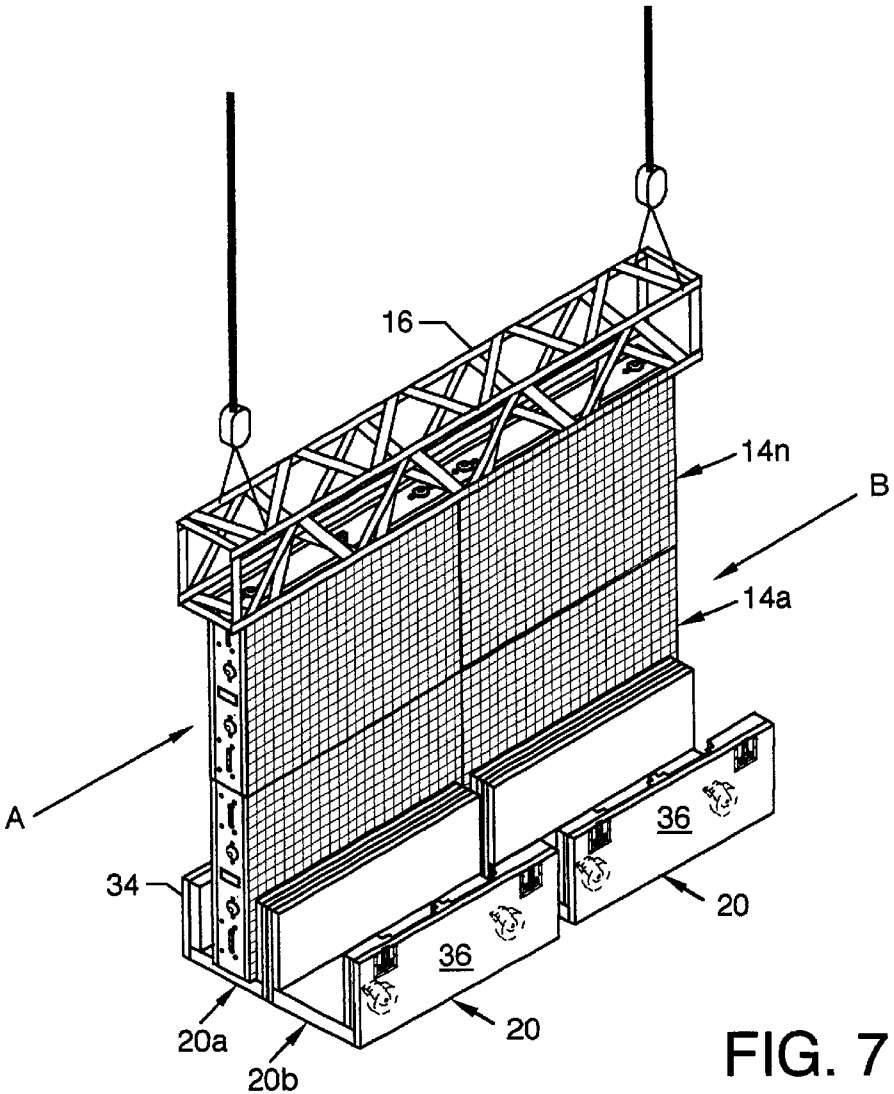
FIG. 7 illustrates the lowering of the lifting truss and the mated and aligned electronic display modules of the first row to meet and attach to the mated and aligned electronic display modules of the second row; and, FIG. 8 illustrates the upward positioning of the lifting truss to remove the array of connected and mated electronic display modules from the adjacent case bases to raise such array to a viewable elevated position.

FIG. 7 illustrates the lowering of the lifting truss 16 and the mated and aligned electronic display modules of the first row A to meet and attach to the mated and aligned electronic display modules of the second row B which are still resting in the case bases 20, thereby forming an array of electronic display modules composed of the electronic display modules in rows A and B.

Figure 8:
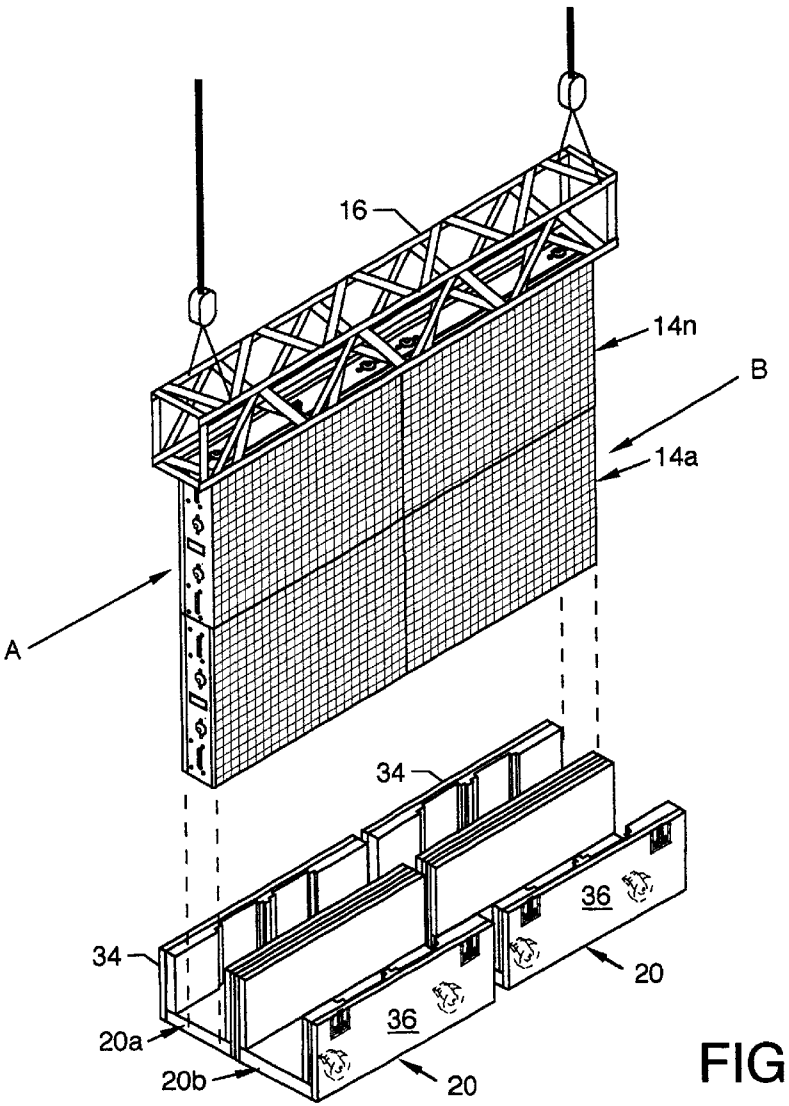

FIG. 8 illustrates the upward positioning of the lifting truss 16 to remove the array of connected and mated electronic display modules which are in row form, from the adjacent case bases 20 to raise such array to a viewable elevated position. Although just four electronic display modules 14*a*–14*n* are shown, it is to be appreciated that various numbers of electronic display modules may be incorporated. For example, just one row of electronic display modules could be used in a 1×2 configuration (one row with two electronic display modules), or more combinations could be incorporated, such as 2×3 (two rows each with three electronic display modules), 2×4, 3×3, 4×4 and the like, to create a suitably sized array. Of course, removal and breaking down of the transportable electronic sign display system 10 would incorporate the reversal of the steps required for erection of such a system.

Various modifications can be made to the present invention without departing from the apparent scope thereof.

PARTS LIST

| | | | |
|---|---|---|---|
| 10 | transportable electronic sign display system | 32a–n | latch actuators |
| | | 34 | panel |
| | | 36 | panel |
| 12a–n | protective cases | 38a–n | handhold fixtures |
| 14a–n | electronic display modules | 40a–n | stacking dishes |
| 16 | lifting truss | 42a–n | casters |
| 18a–b | case halves | 44 | bottom |
| 20 | case base | 46 | panel |
| 20a–b | case base halves | 48 | foam panel |
| 22a | top | 50 | foam panel |
| 22b | side | 52 | bottom |
| 22c | side | 54 | panel |
| 22d | front | 56 | foam panel |
| 23a | top | 58 | foam panel |
| 23b | side | 59 | securing straps |
| 23c | side | 60a–n | alignment fixtures |
| 23d | front | 63 | handle fixtures |
| 24 | cutout | 64 | lifting lug |
| 25 | cutout | 68 | end |
| 26a–n | latch actuators | 70 | end |
| 28a–n | latch receivers | 72 | arrow |
| 30a–n | latch receivers | 74 | arrow |

What is claimed is:

1. A process for providing and handling an electronic sign display comprising the steps of:

a. packing and shipping a plurality of electronic display modules in a plurality of protective cases with at least one electronic display module in each protective case;

b. partially unpacking each of said electronic display modules from said protective cases;

c. aligning each of said partially unpacked electronic display modules with respect to each other to form a row of electronic display modules for an electronic display;

d. connecting the aligned, partially unpacked electronic display modules formed in the row; and, e. lifting the row of the connected, aligned, partially unpacked electronic display modules to a fully unpacked condition separated from said protective cases, thereby forming an electronic sign display.

2. The process of claim 1, further comprising the steps of:

a. packing and shipping a second plurality of electronic display modules in the plurality of protective cases with at least one electronic display module of the second plurality of electronic display modules in each protective case;

b. partially unpacking the at least one electronic display module of the second plurality of electronic display modules from each protective case;

c. aligning each of said partially unpacked electronic display modules of the second plurality of electronic display modules with respect to each other to form a second row of electronic display modules for an electronic sign display;

d. connecting the aligned, partially unpacked electronic display modules formed in the second row;

e. placing a previously assembled row of electronic display modules atop the second row of electronic display modules and connecting the previously assembled row to the second row; and, f. lifting the connected previously assembled row and the second row of the connected, aligned, partially unpacked electronic display modules to fully unpack the second row from the protective cases thereby forming an electronic sign display.

3. The process of claim 2, wherein the previously assembled row is the first row of the electronic sign display.

4. The process of claim 2, wherein each of the protective cases contains an electronic display module of the first plurality and an electronic display module of the second plurality.

5. The process of claim 4, wherein each protective case includes a base and a pair of separable case halves, and wherein the steps of partially unpacking include separating the separable case halves from the base with the partially unpacked electronic display modules remaining with the base.

6. The process of claim 5, wherein each base includes casters and the steps of aligning include movement of at least one base and partially unpacked electronic display module relative to another base and partially unpacked electronic display module.

7. The process of claim 2, wherein the previously assembled row is the first row of the electronic sign display, each of the protective cases contains an electronic display module of the first plurality and an electronic display module of the second plurality packed in a mirror image arrangement on a castered base and covered, during shipping, with separable case halves, and further wherein the steps of partially unpacking include separating the separable case halves from the base with the partially unpacked electronic display modules remaining with the base, and further comprising the step of rotating each of the castered bases 180 degrees subsequent to lifting the first row and prior to aligning the second row.

8. The process of claim 7, wherein the partially unpacked electronic display modules protrude from the castered base to facilitate alignment and connection of the partially unpacked electronic display modules into a row.

9. The process of claim 7, wherein the two electronic display modules packed together in a protective case are adjoining members of a column in the resulting electronic sign display.

10. The process of claim 9, wherein each electronic display module includes a lifting lug, the lifting lug of an uttermost electronic display module of a column being available for connection to a lifting truss.

11. The process of claim 2, wherein lifting the connected previously assembled row and the second row of the connected, aligned, partially unpacked electronic display modules to fully unpack the second row thereby forming an electronic sign display includes connection to a lifting truss.

12. The process of claim 1, wherein the step of lifting the row is performed by a lifting truss.

13. The process of claim 1, further comprising the disassembly steps of:

a. lowering the electronic sign display and partially packing the row of connected, aligned, electronic display modules into aligned protective cases;

b. disconnecting the partially packed electronic display modules;

c. unaligning the disconnected, partially packed electronic display modules; and, d. fully packing the unaligned, disconnected partially packed electronic display modules within the protective cases.

14. The process of claim 13, further comprising the step of shipping the fully packed electronic display modules.

15. The process of claim 14, wherein the protective cases are castered and the shipping step includes moving the fully packed electronic display modules in the protective cases by rolling on the casters.

16. The process of claim 13, wherein the protective cases are castered and the casters are available for movement of the partially packed electronic display modules and the unaligning step includes moving the partially packed, disconnected electronic display modules by rolling on the casters.

17. The process of claim 13, further comprising the step of strapping the partially packed electronic display modules to bases of the protective cases.

18. The process of claim 1, wherein each electronic display module is strapped within a protective case for shipping and the step of partially unpacking includes unstrapping the electronic display module from the protective case.

19. The process of claim 1, wherein the each protective case includes a foam panel providing protection to an electronic display module packed therein.

20. A process for providing and handling a transportable electronic sign display comprising the steps of:

a. providing a plurality of electronic display modules in a plurality of protective cases having castered bases, the protective cases being characterized by the ability to be broken down to partially expose the electronic display modules for assembly into rows while maintaining support by the castered bases;

b. partially exposing the plurality of electronic display modules by breaking down the protective cases;

c. assembling a row of the plurality of partially exposed electronic display modules, the assembled row having support on the castered bases; and, d. lifting the assembled row from the castered bases to provide an electronic sign display.

21. The process of claim 20, further comprising the steps of:

a. providing a second plurality of electronic display modules in the protective cases having castered bases;

b. partially exposing the second plurality of electronic display modules by further breaking down the protective cases;

c. assembling a second row of the second plurality of partially exposed electronic display modules, the second assembled row having support on the castered bases; and, d. attaching the second assembled row beneath the first assembled row and lifting the second assembled row from the castered bases to fully expose the second assembled row and thereby provide a larger electronic sign display.

22. The process of claim 21, further comprising the steps of:

a. providing a third plurality of electronic display modules in a second plurality of protective cases having castered bases, the protective cases being characterized by the ability to be broken down to partially expose the electronic display modules therein;

b. partially exposing the third plurality of electronic display modules by breaking down their protective cases;

c. assembling a third row of the third plurality of partially exposed electronic display modules, the third assembled row having support on the castered bases of the second plurality of protective cases; and, d. attaching the third assembled row beneath the second assembled row and lifting the third assembled row from the castered bases of the second plurality of protective cases to provide a still larger electronic sign display.

23. The process of claim 21, further comprising the steps of:

a. lowering the previously lifted first and second assembled rows such that the second assembled row has support in the castered bases of the protective cases;

b. separating the second assembled row from the first assembled row and relifting the first assembled row; and, c. disassembling the electronic display modules of the second assembled row and moving the disassembled electronic display modules in the castered bases.

24. The process of claim 23, further comprising the step of reassembling the broken-down protective cases about the electronic display modules.

25. The process of claim 24, wherein the step of reassembling is preceded by adding the first assembled row of electronic display modules to the castered bases of the protective cases.

26. The process of claim 25, wherein electronic display modules are arranged in mirror image relationships in the castered bases and the castered bases are rotated 180 degrees between the step of separating the second assembled row from the first assembled row and the step of adding the first assembled row of electronic display modules to the castered bases of the protective cases.

27. The process of claim 20, wherein the assembled row is lifted by attachment beneath a lifting truss.

28. A process for deploying a transportable electronic signage array comprising the steps of:

a. providing multiple protectively encased electronic display modules, each of the electronic display modules being carried upon a maneuverable case base and covered by a protective casing;

b. removing the protective casings to uncover the electronic display modules carried upon the maneuverable case bases;

c. aligning multiple electronic display modules from a rear position of adjacently positioned case bases in end-to-end relationship to form a first row of aligned electronic display modules while on adjacently positioned maneuverable case bases;

d. lowering a lifting truss to meet and attach to the aligned electronic display modules in the first row;

e. raising the lifting truss to remove the first row of aligned electronic display modules from the case bases to a position suspended above the adjacently positioned case bases;

f. maneuveringly rotating the case bases 180 degrees to place remaining electronic display modules into a second row of aligned electronic display modules in alignment below the suspended first row of aligned electronic display modules;

g. lowering the lifting truss and attached first row of aligned electronic display modules to meet and attach to the second row of aligned electronic display modules in adjacent case bases, thus forming an array of electronic display modules; and, h. again raising the lifting truss to remove the second row of aligned electronic display modules from adjacent case bases and to elevate the array to a viewable elevated position.

29. A process for assembling an electronic sign array comprising the steps of:

a. providing an electronic display module on a separable castered base;

b. lifting the electronic display module from the separable castered base;

c. providing another electronic display module on the separable castered base;

d. mating the another electronic display module below the electronic display module; and, e. lifting the mated another electronic display module from the separable castered base by lifting the electronic display module to form an electronic sign array.

30. The process of claim 29, including attaching the provided electronic display module to a row member electronic display module, the row member electronic display module being provided upon another separable castered base.

31. The process of claim 30, including attaching the provided another electronic display module to another row member electronic display module, the another row member electronic display module being supported by the another separable castered base.

32. The process of claim 31, further comprising the steps of:

a. mating the another row member electronic display module below the row member electronic display module; and, b. lifting the mated another row member electronic display module from the another separable castered base simultaneously with the step of lifting the mated another electronic display module, by lifting the attached row member electronic display module simultaneously with the step of lifting the electronic display module.

33. The process of claim 32, wherein the electronic display module and the another electronic display module are both provided on the same separable castered base and sequentially lifted therefrom, and wherein the row member electronic display module and the another row member electronic display module are both provided on the same another separable castered base and sequentially lifted therefrom.

34. The process of claim 33, wherein the separable castered base and the another separable castered base are each rotated 180 degrees between the sequential liftings.

35. The process of claim 33, wherein the electronic display module and the another electronic display module as provided on the same separable castered base both protrude therefrom and wherein the row member electronic display module and the another row member electronic display module as provided on the same another separable castered base both protrude therefrom, such that maneuvering the castered base and the another castered base facilitates attachment.

36. The process of claim 29, further comprising the step of removing a case half from the separable castered base prior to the lifting step.

37. The process of claim 36, wherein the case half is one of a pair of case halves on the separable castered base.

* * * * *